US006061871A

United States Patent [19]

Wang

[11] Patent Number: 6,061,871

[45] Date of Patent: May 16, 2000

[54] HANDLE RELEASE ASSEMBLY FOR A LUGGAGE CARRIER

[76] Inventor: King-Sheng Wang, No. 17, Lane 116, Ta An Gan Rd., Tachia Chen, Taichung Hsien, Taiwan

[21] Appl. No.: 09/088,970

[22] Filed: Jun. 2, 1998

[51] Int. Cl.[7] ..... A47B 95/02

[52] U.S. Cl. ..... 16/113.1; 190/115; 280/37; 280/655; 280/655.1; 280/47.24; 280/47.26

[58] Field of Search ..... 16/113.1, 405, 16/429; 190/39, 115, 18 A, 15 R, 104, 14; 280/37, 651, 652, 655, 655.1, 47.18, 47.24, 47.26

[56] References Cited

U.S. PATENT DOCUMENTS

| | | | |
|---|---|---|---|
| 5,502,876 | 4/1996 | Wang | 16/113.1 |
| 5,581,846 | 12/1996 | Wang | 16/113.1 |
| 5,630,250 | 5/1997 | Chou | 16/113.1 |
| 5,694,663 | 12/1997 | Tserng | 16/113.1 |
| 5,803,214 | 9/1998 | Wang | 190/115 |
| 5,875,520 | 3/1999 | Chang | 16/113.1 |

*Primary Examiner*—Chuck Y. Mah
*Attorney, Agent, or Firm*—Omri M. Behr, Esq.

[57] ABSTRACT

A handle release assembly includes a supporting bracket having two end portions each formed with a leg containing a first passage, a cover fixedly mounted on the supporting bracket and having two end portions and a mediate portion containing a second passage, two drawing bars each having one end portion extending through the first passage of the supporting bracket to be fixedly attached to the respective end portion of the cover and containing an elongate guiding slot, a pressing block slidably mounted in the second passage and having two end portions, and two pivot blocks each pivotally mounted in the cover and each having a first end portion formed with an ear pivotally connected with the respective end portion of the pressing block and a second end portion formed with a rod received in the guiding slot of the first end portion of the respective drawing bar.

5 Claims, 6 Drawing Sheets

HANDLE RELEASE ASSEMBLY FOR A LUGGAGE CARRIER

FIELD OF THE INVENTION

The present invention relates to a handle release assembly, and more particularly to a handle release assembly for a suitcase.

BACKGROUND OF THE INVENTION

A conventional retractable handle assembly for a suitcase comprises two inner tubes each slidably mounted in a respective outer tube, a substantially inverted U-shaped handle including two legs each secured to the respective inner tube for moving each of the two inner tubes, and a handle control device for controlling the movement of each of the two inner tubes in the respective outer tube. However, the handle control device of the conventional retractable handle assembly has a complex construction, thereby greatly increasing the cost in manufacturing and assembling the retractable handle assembly.

The present invention has arisen to mitigate and/or obviate the disadvantage of the conventional retractable handle assembly.

SUMMARY OF THE INVENTION

In accordance with one aspect of the present invention, there is provided a handle release assembly comprising a supporting bracket including two end portions each formed with a leg extending downward and containing a first passage, a cover fixedly mounted on the supporting bracket and including two end portions and a mediate portion containing a second passage, two drawing bars each including a first end portion extending through the first passage of the supporting bracket, fixedly attached to the respective end portion of the cover and transversely containing an elongate guiding slot, and each including a second end portion, a pressing block slidably mounted in the second passage and including two end portions, and two pivot blocks each pivotally mounted in the cover and each including a first end portion formed with an ear pivotally connected with the respective end portion of the pressing block and a second end portion formed with a rod received in the guiding slot of the first end portion of the respective drawing bar.

Further features of the present invention will become apparent after a careful reading of the detailed description with appropriate reference to the accompanying drawings.

DETAILED DESCRIPTION OF THE PREFERRED EMBODIMENTS

Figure 1:
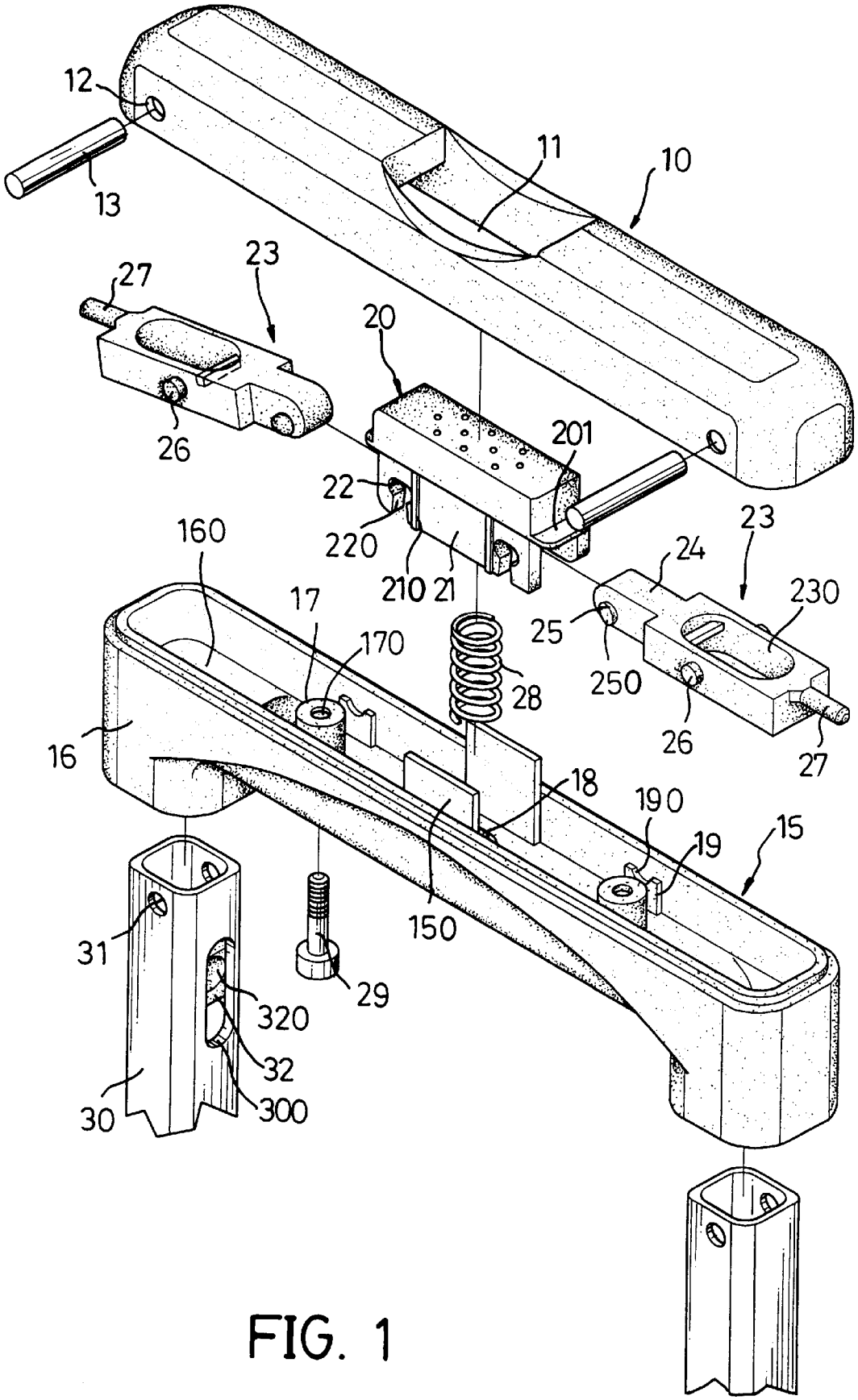
FIG. 1 is a exploded view of a handle release assembly in accordance with the present invention.
Figure 2:
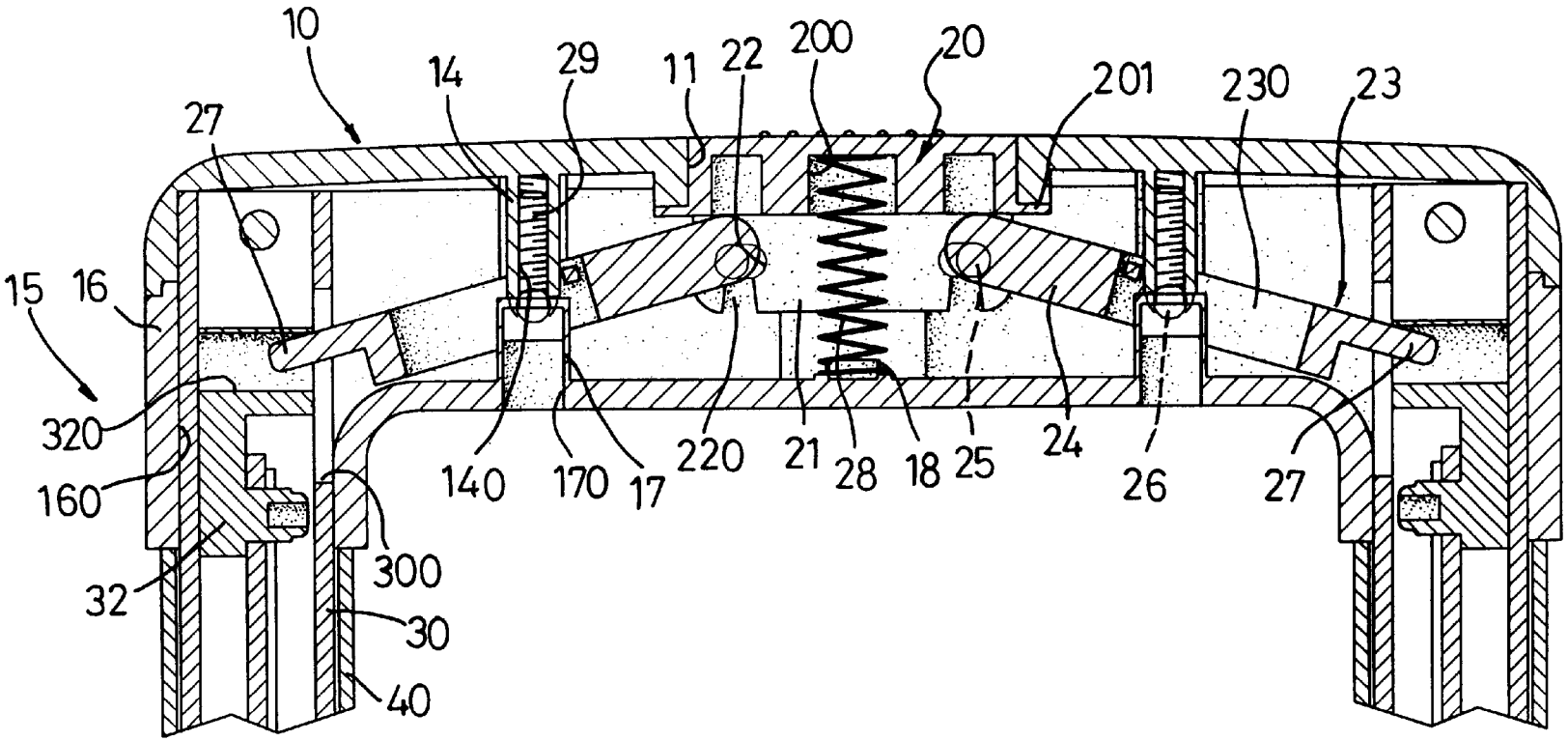
FIG. 2 is a front plan cross-sectional view of the handle assembly as shown in FIG. 1.

Referring to the drawings and initially to FIGS. 1 and 2, a handle release assembly in accordance with the present invention can be adapted to be used for a suitcase (not shown) and comprises a supporting bracket 15 including two end portions each formed with a leg 16 extending downward and containing a first passage 160, a cover 10 fixedly mounted on the supporting bracket 15 and including two end portions and a mediate portion containing a second passage 11, two drawing bars 30 each including a first end portion extending through the first passage 160 of the supporting bracket 15, fixedly attached to the respective end portion of the cover 10 and transversely containing an elongate guiding slot 300, and each including a second end portion, a pressing block 20 slidably mounted in the second passage 11 and including two end portions, and two pivot blocks 23 each pivotally mounted in the cover 10 and each including a first end portion formed with an ear 24 pivotally connected with the respective end portion of the pressing block 20 and a second end portion formed with a rod 27 received in the guiding slot 300 of the first end portion of the respective drawing bar 30.

Each of the two end portions of the cover 10 contains a first through hole 12, the first end portion of each of the two drawing bars 30 contains two second through holes 31 each aligning with the first through hole 12 of the respective end portion of the cover 10, and two positioning pins 13 each extend through the first through hole 13 of the respective end portion of the cover 10 and through the second through holes 31 of the respective drawing bar 30, thereby securing each of the two drawing bars 30 to the cover 10.

Each of the two end portions of the pressing block 20 is formed with an abutting piece 201 each received in the cover 10. A biasing member 28 is mounted between the supporting bracket 15 and the pressing block 20. The pressing block 20 contains a retaining recess 200, the supporting bracket 15 includes a bottom wall formed with a retaining stub 18, and the biasing member 28 includes a first end portion received in the retaining recess 200 and a second end portion fixedly mounted on the retaining stub 18.

The supporting bracket 15 includes two side walls each including two end portions each mounted with a supporting piece 19 containing a semicircular bearing surface 190, and each of the two pivot blocks 23 is pivotally mounted between the two side walls of the supporting bracket 15 and includes two sides each formed with a pivot stub 26 pivotally received in the a semicircular bearing surface 190 of the supporting piece 19.

The bottom wall of the supporting bracket 15 is formed with two first columns 17 each disposed between two juxtaposed supporting pieces 19 and each containing a hole 170, the cover 10 includes a top wall formed with two second columns 14 each containing a threaded hole 140 aligning with the hole 170 of the respective first column 17, and two positioning bolts 29 each extend through the hole 170 of the respective first columns 17 and are each threadedly engaged in the threaded hole 140 of the respective second column 14. Each of the two pivot blocks 23 contains an elongate receiving slot 230 for receiving the respective first column 17 therein.

The pressing block 20 includes two side walls 21 each including two end portions each containing a pivot hole 22, and the ear 24 of each of the two pivot blocks 23 is pivotally mounted between the two side walls 21 of the pressing block 20 and includes two sides each formed with a pivot boss 25 pivotally received in the pivot hole 22 of the respective end portion of each of the two side walls 21 of the pressing block 20.

The pivot hole 22 of each of the two side walls 21 of the pressing block 20 contains a guiding channel 220 for guiding the pivot boss 25 to be inserted into the respective pivot hole 22. The pivot boss 25 of each of the two sides of the ear 24 of each of the two pivot blocks 23 is formed with a beveled surface 250.

Preferably, each of the two side walls 21 of the pressing block 20 abuts on the respective side wall of the supporting bracket 15 and contains a guiding chute 210, and two supporting plates 150 are each fixedly mounted on the respective side wall of the supporting bracket 15 and are each received in the guiding chute 210 of the respective side wall 21 of the pressing block 20.

Figure 3:
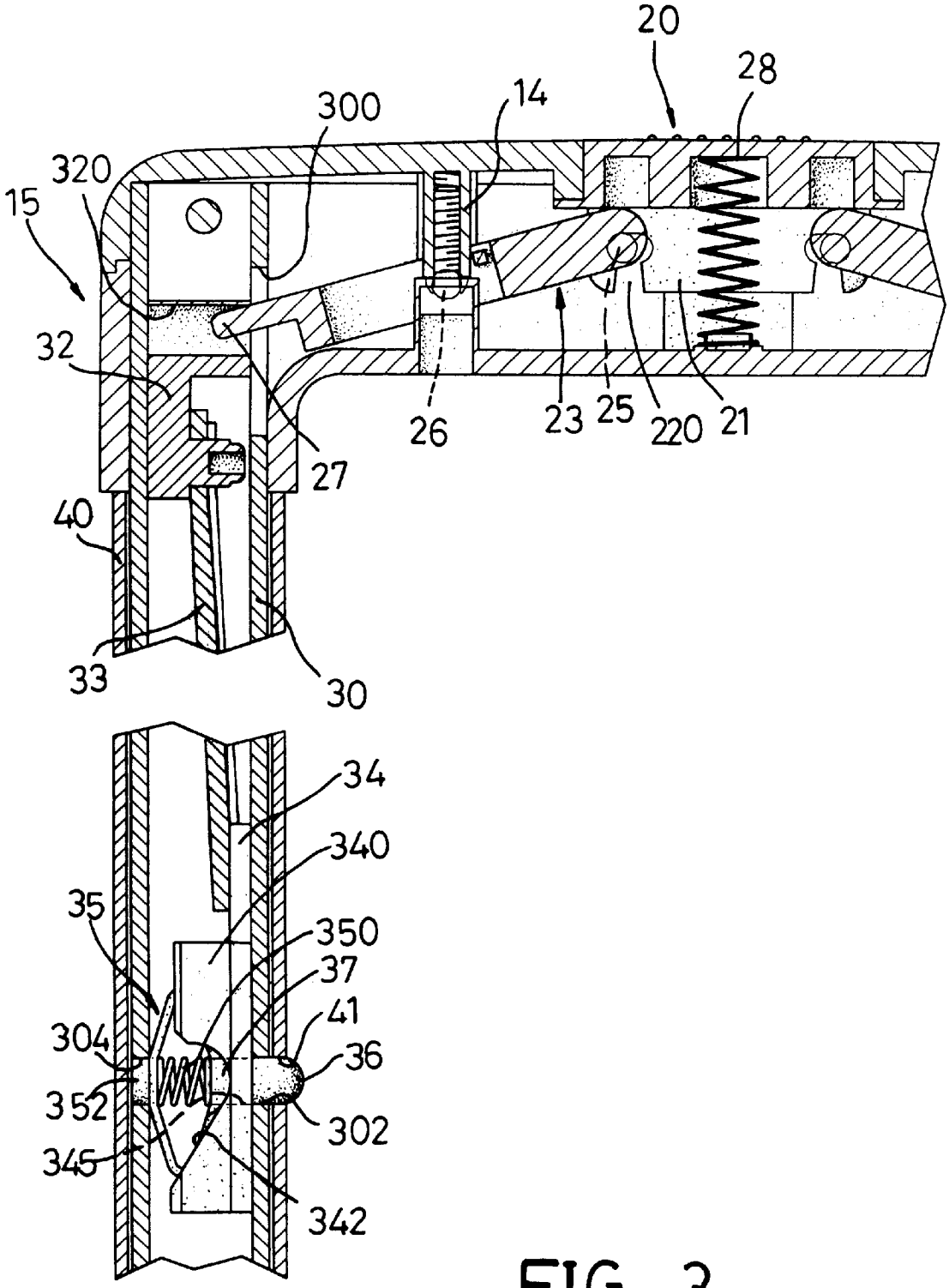
FIG. 3 is a further front plan cross-sectional view of the handle assembly as shown in FIG. 1.
Figure 4:
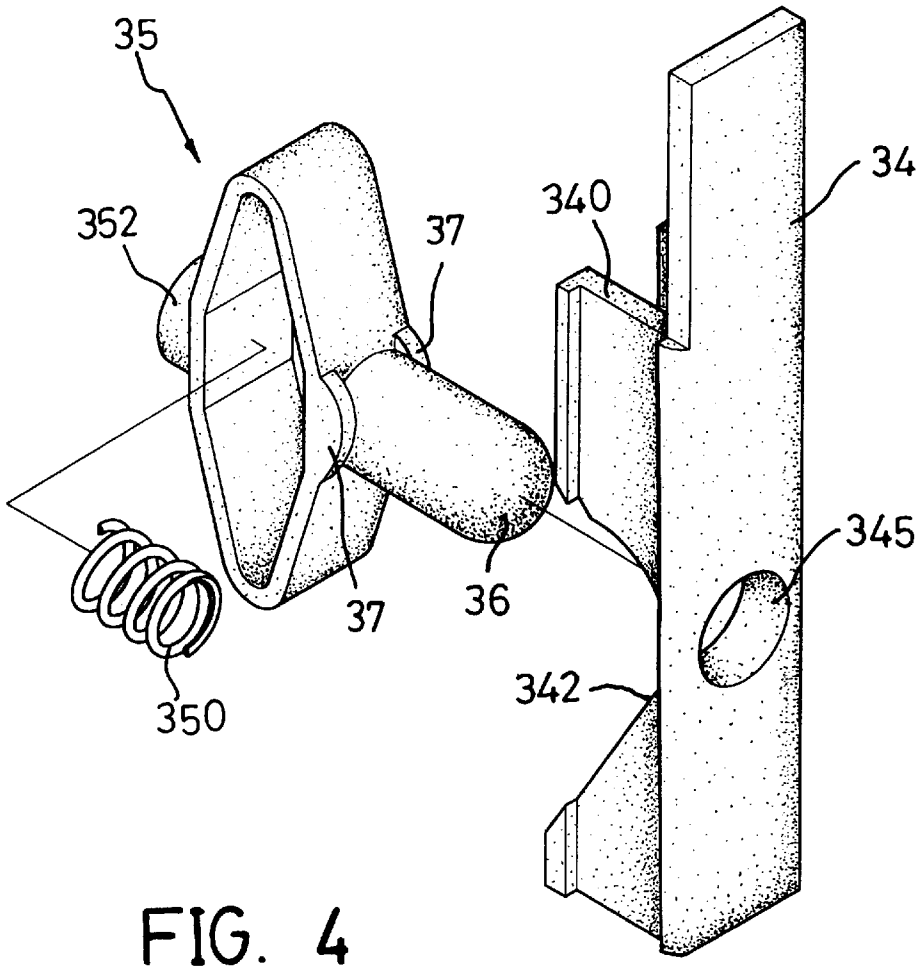
FIG. 4 is an exploded view showing a sliding member and an elastic member.

Referring now to FIGS. 3 and 4 with reference to FIGS. 1 and 2, the suitcase includes two outer bars 40 each having a first end portion and a second end portion, and each of the two drawing bars 30 can be received in the respective outer bar 40. Two slides 32 are each slidably received in the respective drawing bar 30 and each contains a space 320 for receiving the rod 27 of the respective pivot block 23.

Two connecting levers 33 each include a first end portion fixedly mounted on the respective slide 32 and a second end portion. Two sliding members 34 each include a first end portion fixedly connected with the second end portion of the respective connecting lever 33 and a second end portion containing a first bore 345 and formed with two extensions 340 each containing an arcuate recess 342.

Two elastic members 35 each include a first side formed with a retaining post 352 fixedly received in a cavity 304 contained in the second end portion of each of the two drawing bars 30, and a second side formed with an insert 36 extending through the first bore 345 of the respective sliding member 34, through a second bore 302 contained in the second end portion of each of the two drawing bars 30, and through a third bore 41 contained in the second end portion of each of the two outer bars 40. Each of the two elastic members 35 includes a biasing member 350 received therein and includes two flaps 37 each slidably received in the arcuate recess 342 of the respective extension 340.

Figure 5:
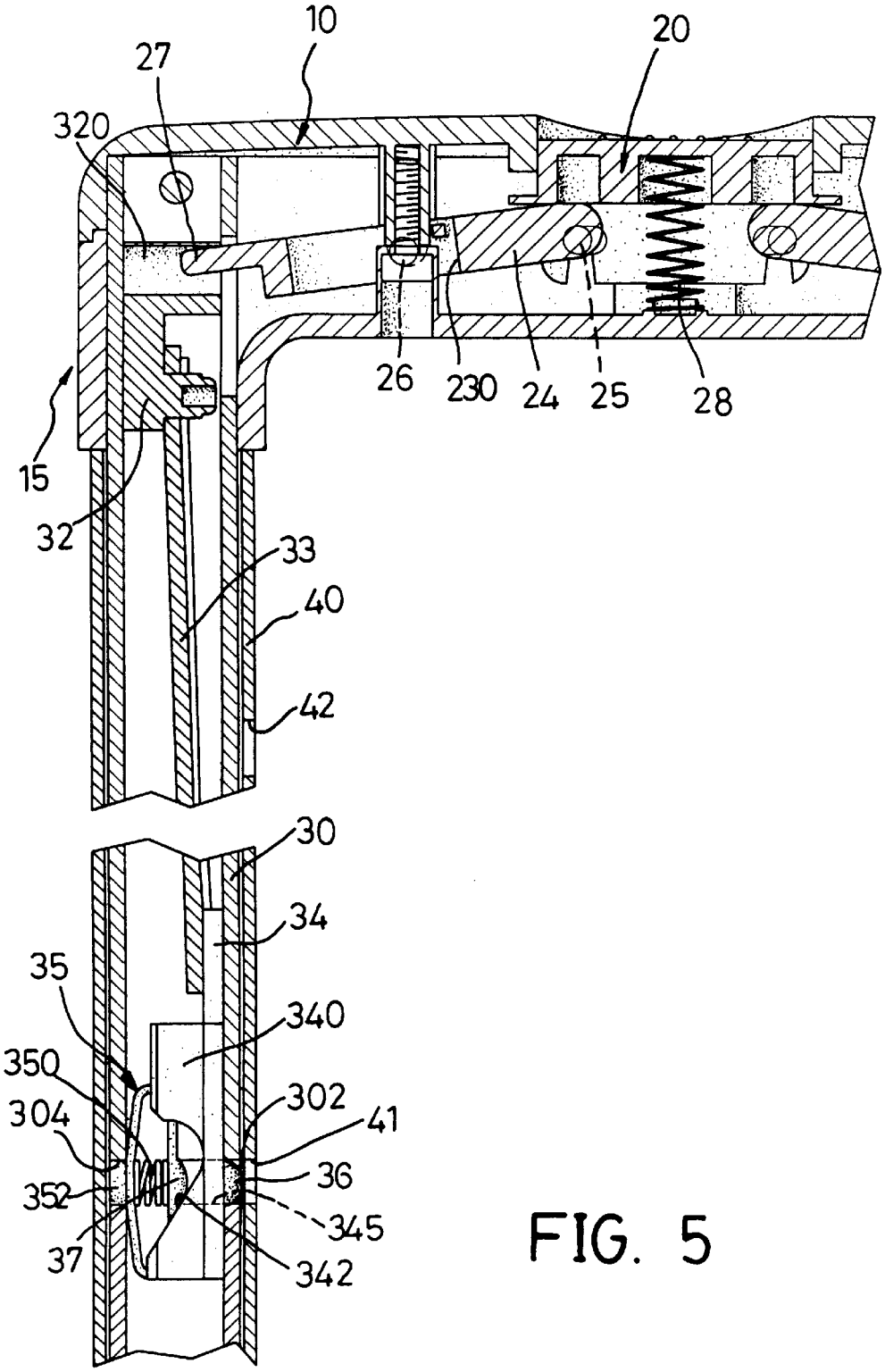
FIG. 5 is an operational view of FIG. 3.

In operation, referring to FIGS. 3–6 with reference to FIGS. 1 and 2, the pressing block 20 can be pressed downward from a first position as shown in FIG. 3 to a second position as shown in FIG. 5, thereby pivoting each of the pivot blocks 23 such that each of the two slides 32 can be moved upward by means of the respective rod 27.

Each of the two connecting levers 33 can then be moved upward by the respective slide 32 so as to move the sliding member 34 upward which in turn moves each of the two extensions 340 upward such that the elastic member 35 can be pressed inward by means of a sliding motion of the flap 37 in the respective arcuate recess 342, thereby detaching the insert 36 from the third bore 41 as shown in FIG. 5 such that each of the two drawing bars 30 can be moved upward by means of exerting an upward force on the supporting bracket 15.

Figure 6:
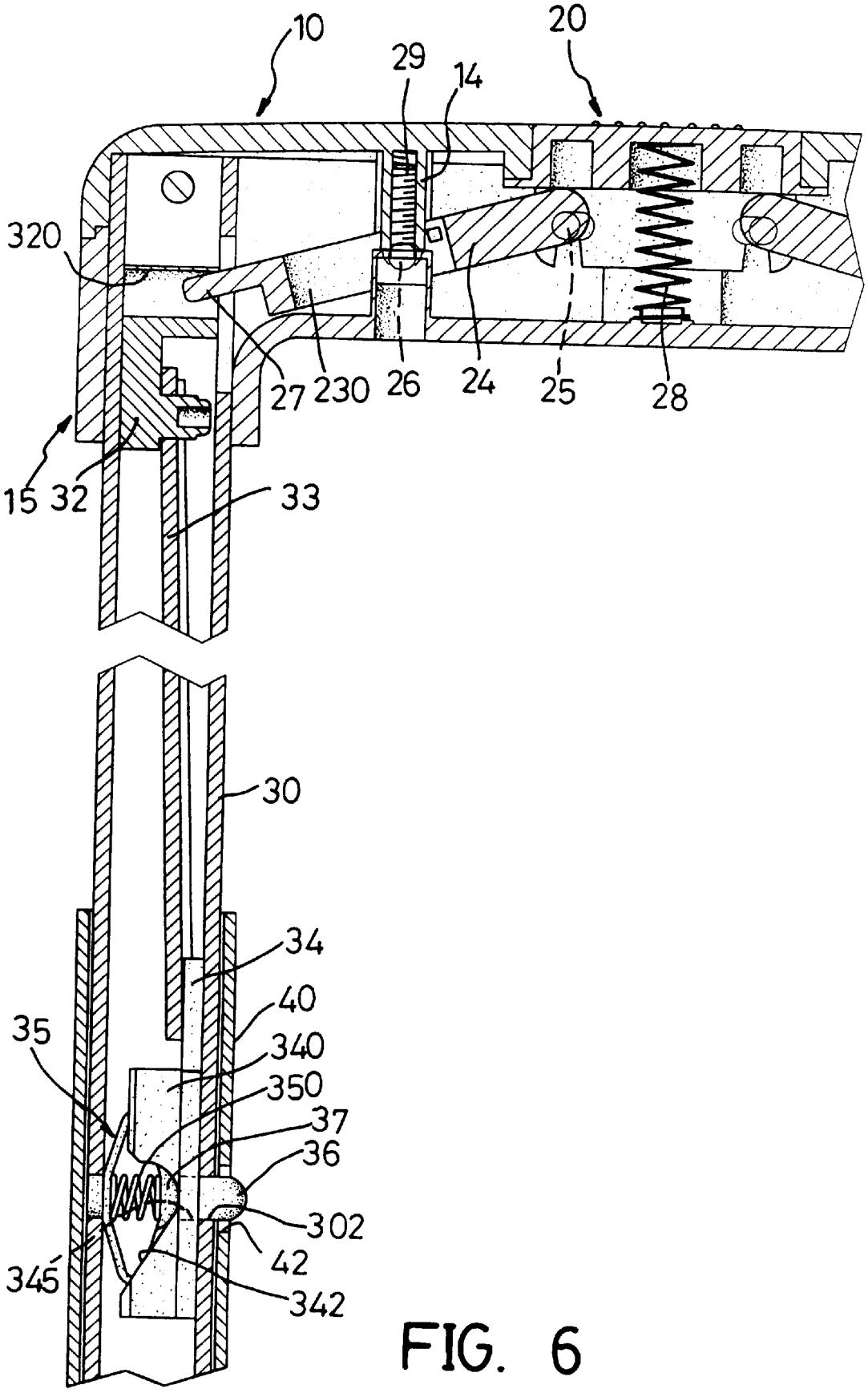
FIG. 6 is a further operational view of FIG. 3.

Each of the two drawing bars 30 can be moved in the respective outer bar 40 until the insert 36 aligns with a fourth bore 42 contained in the first end portion of each of the two outer bars 40 as shown in FIG. 6. In such a situation, the insert 36 of each of the two elastic members 35 can be inserted into the respective fourth bore 42 by means of the returning force of the biasing member 350, thereby securing each of the two drawing bars 30 to the respective outer bar 40 again.

It should be clear to those skilled in the art that further embodiments may be made without departing from the scope and spirit of the present invention.

What is claimed is:

1. A handle release assembly comprising:

a supporting bracket (15) including two end portions each formed with a leg (16) extending downward and containing a first passage (160), two sidewalls each having two end portions each mounted with a supporting piece (19) containing an arcuate cavity (190) and a bottom wall formed with two first columns (17) each containing a hole (170);

a cover (10) fixedly mounted on said supporting bracket (15) and including two end portions, a mediate portion containing a second passage (11) and a top wall formed with two second columns (14) each containing a threaded hole (140) aligning with said hole (170) of one of the corresponding two first columns (17);

two positioning bolts (29) extending through said hole (170) of one of the corresponding two first columns (17) and each screwed into said threaded hole (140) of one of the corresponding two second columns (14);

two drawing bars (30) each including as first end portion extending through one of said first passages (160) of said supporting bracket (15), fixedly attached to one of the corresponding two end portions of said cover (10) and transversely containing an elongate guiding slot (300), and each including a second end portion;

a pressing block (20) slidable mounted in said second passage (11) and including two end portions and two sidewalls (21) each including two end portions each containing a pivot hole (22) with a guiding channel (220) defined therein, said two side walls (21) abutting on one of the corresponding two sidewalls of said supporting bracket (15) and containing a guiding chute (210);

two supporting plates (150) each fixedly mounted on one of the corresponding two sidewalls of said supporting bracket (15) and each received in said guiding chute (210) of one of the corresponding two sidewalls (21) of said pressing block (20); and two pivot blocks (23) each pivotally mounted between said two sidewalls of said supporting bracket (15) and having two sides each formed with a pivot stud (26) pivotally received in said arcuate cavity (190) of said supporting piece (19), each including a first end portion formed with an ear (24) pivotally connected with one of the corresponding two end portions of said pressing block (20), a second end portion formed with a rod (27) received in said guiding slot (300) of said first end portion of one of the corresponding two drawing bars (30) and an elongate receiving slot (230) for receiving one of the corresponding two first columns (17) therein, said ear (24) pivotally mounted between said two sidewalls (21) of said pressing block (20) and including two sides each formed with a pivot boss (25) guided by said guiding channel (220) to pivotally receive in said pivot hole (22) of one of the corresponding two end portions of each of said two sidewalls (21) of said pressing block (20) and said Divot boss (25) formed with a beveled surface (250).

2. The handle release assembly in accordance with claim 1, further comprising a biasing member (28) mounted between said supporting bracket (15) and said pressing block (20).

3. The handle release assembly in accordance with claim 2, wherein said pressing block (20) contains a retaining recess (200), said supporting bracket (15) includes a bottom wall formed with a retaining stub (18), and said biasing member (28) includes a first end portion received in said retaining recess (200) and a second end portion fixedly mounted on said retaining stub (18).

4. The handle release assembly in accordance with claim 1, wherein each of said two end portions of said pressing block (20) is formed with an abutting piece (201) each received in said cover (10).

5. The handle release assembly in accordance with claim 1, wherein each of said two end portions of said cover (10) contains a first through hole (12), said first end portion of each of said two drawing bars (30) contains a second through hole (31) aligning with said first through hole (12) of one of the corresponding two end portions of said cover (10), and said handle release assembly further comprises two positioning pins (13) each extending through said first through hole (13) of one of the corresponding two end portions of said cover (10) and through said second through hole (31) of one of the corresponding two drawing bars (30).

* * * * *